US010746372B2

(12) United States Patent
Sousek et al.

(10) Patent No.: US 10,746,372 B2
(45) Date of Patent: Aug. 18, 2020

(54) LIGHTING DEVICE INTEGRATING PAIR OF LIGHT FUNCTIONS WITH COLLIMATING ELEMENTS ASSOCIATED WITH PRIMARY LIGHT SOURCES AND LIGHT GUIDING ELEMENTS ASSOCIATED WITH SECONDARY LIGHT SOURCES

(71) Applicant: Varroc Lighting Systems, s.r.o., Senov u Noveho Jicina (CZ)

(72) Inventors: Pavel Sousek, Novy Jicin (CZ); Tomas Socha, Namestovo (SK); David Najdek, Zelinkovice (CZ)

(73) Assignee: Varroc Lighting Systems, S.R.O., Senov U Noveho Jicina (CZ)

( * ) Notice: Subject to any disclaimer, the term of this patent is extended or adjusted under 35 U.S.C. 154(b) by 0 days.

(21) Appl. No.: 16/283,070

(22) Filed: Feb. 22, 2019

(65) Prior Publication Data

US 2019/0264886 A1 Aug. 29, 2019

(30) Foreign Application Priority Data

Feb. 23, 2018 (CZ) ..... PV 2018-95

(51) Int. Cl.

| | |
|---|---|
| ***F21S 43/249*** | (2018.01) |
| ***F21S 43/20*** | (2018.01) |
| ***F21S 43/239*** | (2018.01) |
| ***F21S 43/31*** | (2018.01) |

(52) U.S. Cl.

CPC ..... *F21S 43/249* (2018.01); *F21S 43/239* (2018.01); *F21S 43/255* (2018.01); *F21S 43/31* (2018.01)

(58) Field of Classification Search

CPC ..... F21S 43/239; F21S 43/249; F21S 43/255; F21S 43/31; F21S 41/20; F21S 41/24

USPC ..... 362/242, 243

See application file for complete search history.

(56) References Cited

U.S. PATENT DOCUMENTS 4,767,172 A * 8/1988 Nichols ..... F21V 7/0091 355/1
6,527,411 B1 * 3/2003 Sayers ..... F21V 5/007 362/245
7,128,431 B2 * 10/2006 Ludewig ..... G02B 6/04 362/23.09
9,557,024 B2 * 1/2017 Giraud ..... G02B 6/0001

(Continued)

FOREIGN PATENT DOCUMENTS

EP 1304260 4/2003

OTHER PUBLICATIONS

Search Report for CZ Application No. PV 2018-95, dated Nov. 12, 2018.

*Primary Examiner* — Alan B Cariaso

(74) *Attorney, Agent, or Firm* — JK Intellectual Property Law, PA

(57) ABSTRACT

The invention relates to a lighting device with a multiple light function, which comprises a primary light source and secondary light source (2*a*, 2*b*) associated with optical elements which are adapted to guide light to the output of the device. The primary light source (2*a*) is associated with collimating elements (4) and the secondary light source (2*b*) is associated with light guiding elements (3), whereby the collimating elements (4) and the light guiding elements (3) are arranged in a common light guiding body (A), the output of the light beams is situated behind the level (6) of the exit ends of the collimating elements (4) and on the output side of light guiding body (A) a light scattering filter (7) is arranged.

11 Claims, 9 Drawing Sheets

(56) References Cited

U.S. PATENT DOCUMENTS

| | | | | |
|---|---|---|---|---|
| 2006/0147151 | A1* | 7/2006 | Wanninger ..... | G02B 6/003 385/31 |
| 2009/0154186 | A1* | 6/2009 | Natsume ..... | B60Q 1/0041 362/516 |
| 2009/0207610 | A1 | 8/2009 | Sayers et al. | |
| 2012/0033441 | A1 | 2/2012 | Sousek et al. | |
| 2012/0243220 | A1 | 9/2012 | Yamamoto | |
| 2016/0334074 | A1 | 11/2016 | Fukui et al. | |
| 2017/0276314 | A1 | 9/2017 | Hanulak et al. | |

* cited by examiner

LIGHTING DEVICE INTEGRATING PAIR OF LIGHT FUNCTIONS WITH COLLIMATING ELEMENTS ASSOCIATED WITH PRIMARY LIGHT SOURCES AND LIGHT GUIDING ELEMENTS ASSOCIATED WITH SECONDARY LIGHT SOURCES

TECHNICAL FIELD

The invention relates to a lighting device with a multiple light function, which comprises a primary light source and secondary light source with associated optical elements which are adapted to guide light to the output of the device.

BACKGROUND

In lighting technology, especially in ground vehicle lighting, there is a need to perform multiple light functions on one, i.e., common surface, whereby one light function requires large light scattering and high light homogeneity, whereas the other function requires low light scattering, low light homogeneity and high luminous efficiency, etc. At the same time, however, it is advantageous if the light sources of both different light functions are located on the same carrier, even better in one plane.

There are known flat-shaped light guides with an assembly of collimating elements for leading in light from LED light sources and for emitting the collimated beam in the desired direction. A light scattering filter is placed in the direction of propagation of light beams to scatter the light beams. The disadvantage is that even this light scattering filter does not provide such uniform (homogeneous) light distribution as in the case of direct propagation of light beams from a LED light source to the light scattering filter. This is due to the fact that the light scattering angle from the LED light source is up to 180°, which in a combination with the light scattering filter disposed at a certain distance from the light source ensures a sufficiently homogeneous distribution of the light only when the light from the light source is guided directly into the light scattering filter, but does not guarantee sufficient homogeneity of a collimated light beam.

From US 2016 334 074 A1, a lighting device device is known which includes a plurality of LED light sources and a lens unit which is positioned in a corresponding manner relative to the LED light sources. The lens unit includes a transfer lens, a first totally reflective lens and a second totally reflective lens, whereby the light incident surface and the light emitting surface of the transfer lens, as well as the light incident surfaces and light emitting surfaces and the surfaces with total reflection of the first totally reflective lens and the second totally reflective lens are biaxial anamorphous aspherical surfaces. A micro lens field is formed at least on one the light incident and light emitting surface of the transfer lens. The disadvantage of this arrangement is that it does not solve the problem of performing a pair of different light functions in one output surface.

A similar device is disclosed in US 2009 207 610 A1, which describes a lighting system with a common optical system to perform a pair of light functions in one output surface, e.g., a rear fog light and a rear position light. The lighting system includes a light guide, which has a first side and a second side, whereby the first side of the light guide has a plurality of optical elements formed therein, the optical elements being associated with light sources. The optical element reflects and substantially collimates light beams emitted from the light source via the light guide to form the desired light pattern depending on whether the optical element is associated with the first or second light source. The disadvantage of this arrangement is the inability to achieve the required lighting performance for each of the light functions.

It is an object of the invention to eliminate or at least minimize the drawbacks of the background art, in particular to allow to perform a pair of light functions in one, i.e., a common surface, where one light function requires large angle light scattering and high light homogeneity, but for the second light function low angle light scattering is required, low light homogeneity is sufficient with the advantageous location of the light sources of the two different light functions on the same, i.e., common carrier, preferably in one plane.

SUMMARY

The aim of the invention is achieved by a lighting device with a multiple light function, whose principle consists in that a primary light source is associated with collimating elements and a secondary light source is associated with light guiding elements, whereby the collimating elements and the light guiding elements are arranged in a common light guide body, the output of the light beams from the light guiding elements is located behind the level of the exit ends of the collimating elements and a light scattering filter is arranged on the output side of a light guiding body.

The advantage of the invention is that by means of a specially shaped light guide or two interlocking light guide components, it is possible to achieve two different light functions with a different color or different light intensity or different light distribution in the light emitting area. For example, it is possible to realize a combination of contour/position light and direction indicator (trafficator), or a combination of position light and brake light, under reasonable financial conditions. A further advantage of the invention is to reduce space demands by integrating a pair of light functions into one device.

DESCRIPTION OF DRAWINGS

The invention is schematically illustrated in the drawings, wherein.

DETAILED DESCRIPTION

Figure 1A:
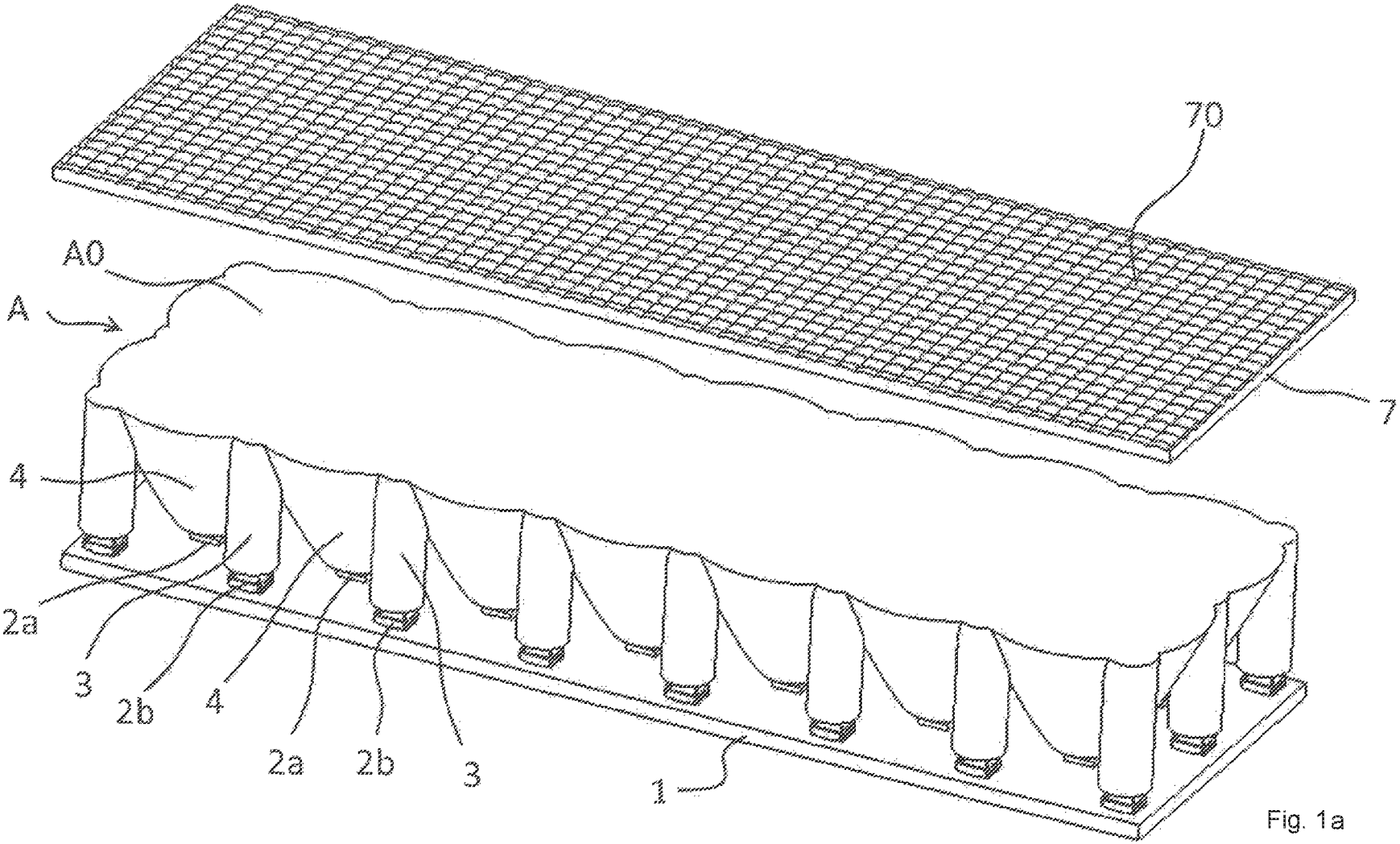
FIG. 1*a* shows an arrangement of a lighting device according to the first embodiment.

The invention will be described with reference to exemplary embodiments of a lighting device with a multiple light function, wherein for one light function high light scattering and high light homogeneity are required, and for the second light function, a small light scattering and low light homogeneity is required, but a high output light power, with the light sources of the two different light functions being located on the same, i.e., common carrier, which is, however, not a necessary condition of the invention.

The lighting device comprises a carrier 1 of primary light sources 2*a* and secondary light sources 2*b*. In an embodiment shown, the carrier 1 consists of a common PCB 1 (printed circuit board), on which, preferably as a pair of matrices in a mutually interleaved configuration, are mounted primary light sources 2*a* and secondary light sources 2*b*, which are connected via PCB 1 to an unillustrated power source and an unillustrated control device. In another exemplary embodiment, e.g. in FIG. 8, the primary light sources 2*a* are mounted on a first carrier 1*a* and the secondary light sources 2*b* are mounted on a second carrier 1*b*. In another unillustrated example of embodiment, each primary light source 2*a* as well as each secondary light source 2*b* is mounted on a separate carrier, or, optionally, the light sources 2*a*, 2*b* are located on several carriers in different advantageous assemblies, etc.

Opposite the primary light sources 2*a*, collimating elements 4 of a light guiding body A are arranged and opposite the secondary light sources 2*b*, light guiding elements 3 of the light guiding body A are arranged. The primary light sources 2*a* are part of the optical system to meet the light output characteristic of the first light function, see FIG. 6, which shows the collimation of light from the primary light sources 2*a* into the output of the lighting device according to the invention. The secondary light sources 2*b* are part of the optical system to meet the light output characteristic of the second light function, see FIG. 5, which shows the scattering of the light from the secondary light sources 2*b* into the output of the lighting device according to the device.

In the exemplary embodiments shown, the light guiding elements 3 are formed by cylindrical light guiding elements, which guide light from the secondary light sources 2*b* through reflections from the circumferential wall of the light guide into the output of the lighting device according to the device. In an unillustrated embodiment, the light guiding elements 3 consist of truncated cones with a slight inclination of the conical surface with respect to the longitudinal axis of the cone of the light guiding element 3, i.e., to the height, which is advantageous, e.g., to facilitate the removal of an optical component from a production mold.

The collimating elements 4 have a known shape of rotational collimating reflective surface 40 in whose center is arranged an input surface 41 of light from the associated primary light source 2*a*, the input surface 41 of the light of the collimating element 4 being formed by a hollow, slightly conical surface with a concave face 42.

The plane matrix distribution of the collimating elements 4 and of the light guiding elements 3 corresponds to the plane matrix arrangement of the primary light sources 2*a* and the secondary light sources 2*b*. In the exemplary embodiments shown, the primary light sources 2*a* and secondary light sources 2*b* are arranged in mutually interleaved square matrices (patterns). In an unillustrated embodiment, the primary light sources 2*a* and secondary light sources 2*b* are arranged in other mutually corresponding planar patterns to provide different light functions at the output of the lighting device according to the invention.

Figure 2A:
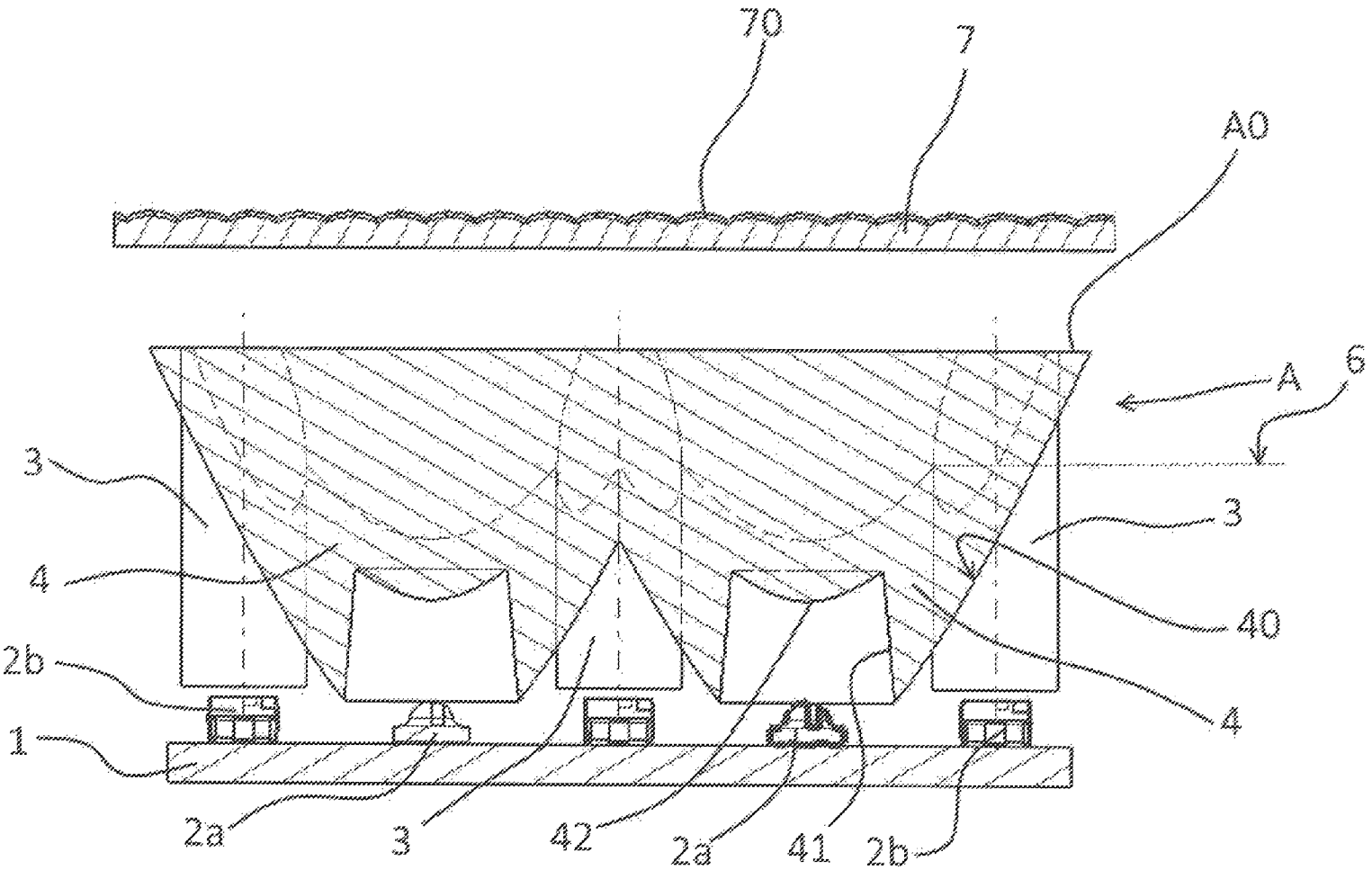
FIG. 2*a* is a cross-sectional view of a row of collimators in the embodiment of the invention according to FIG. 1*a;*
Figure 3:
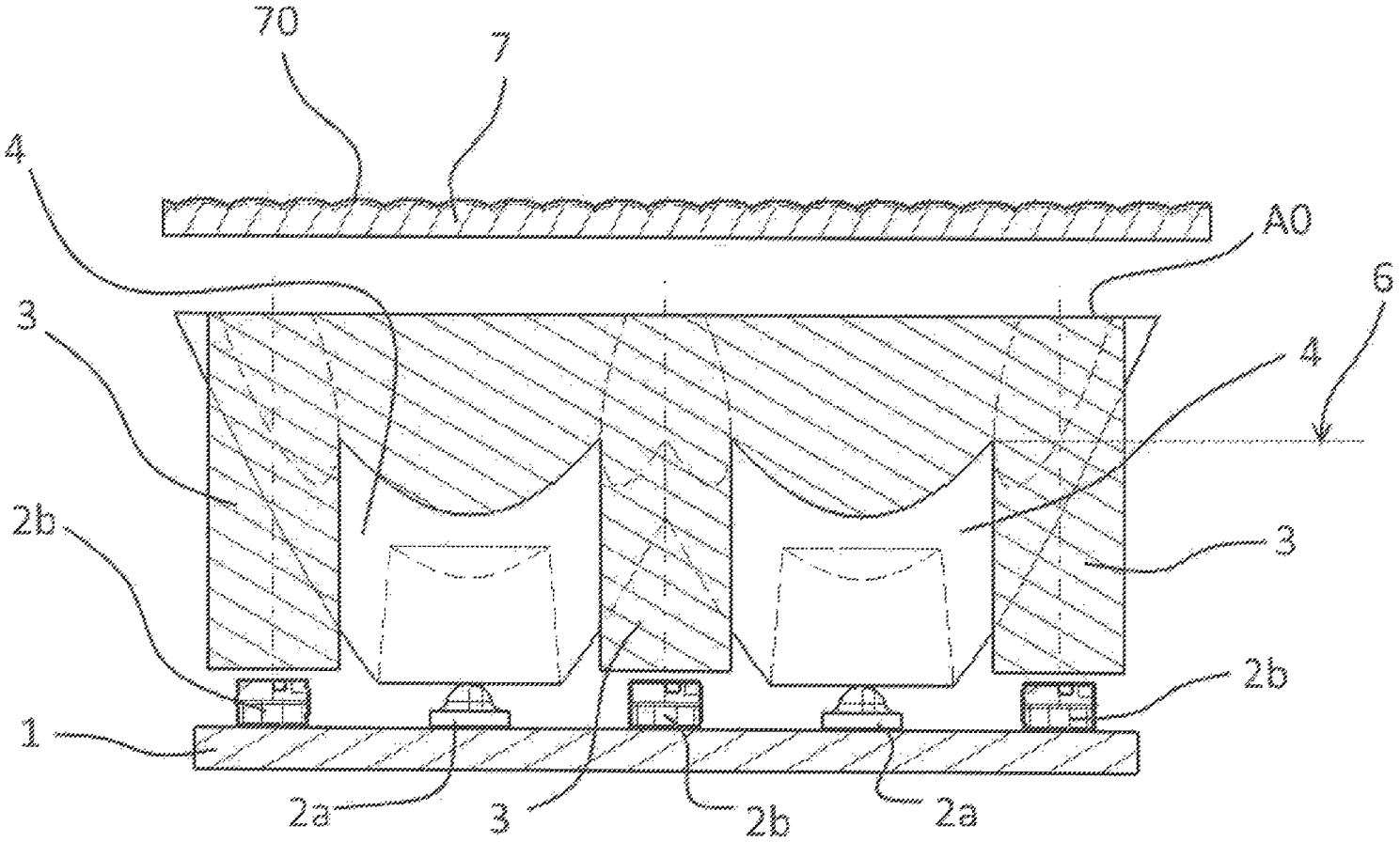
FIG. 3 is a cross-sectional view of light guiding elements in the embodiment of the invention according to FIG. 1*a;*
Figure 5:
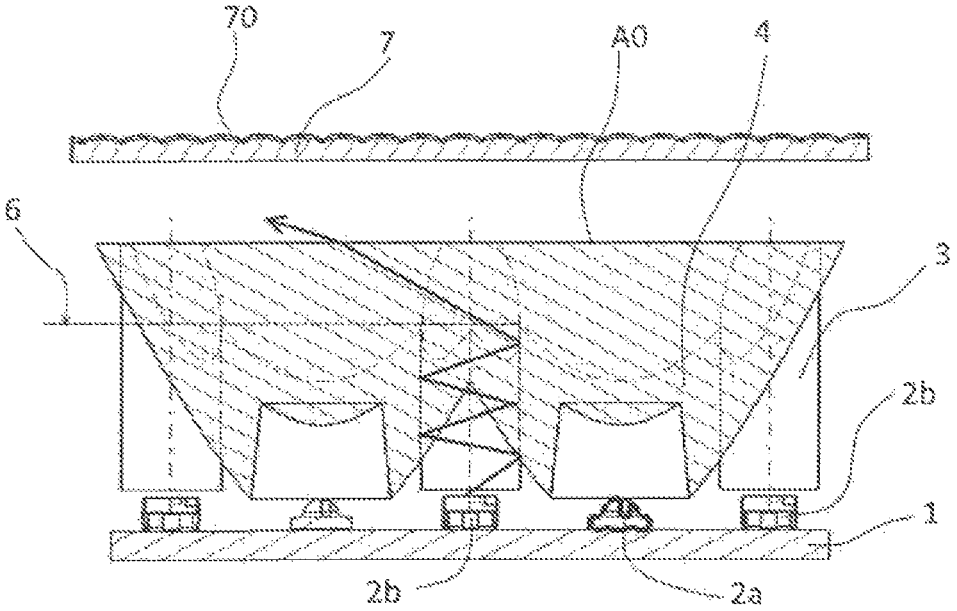
FIG. 5 illustrates the functioning of the light guiding elements for the second light function of the device.
Figure 6:
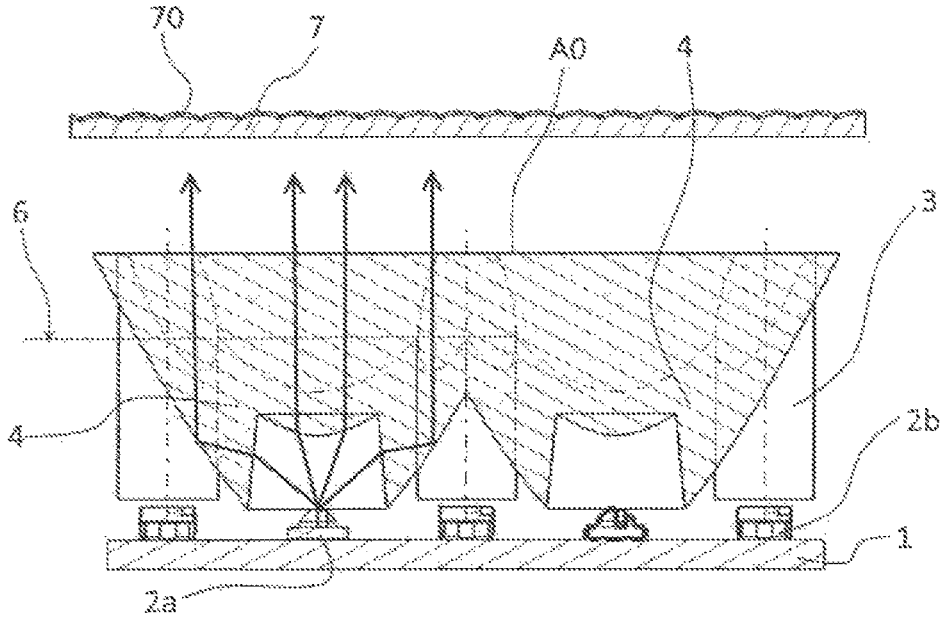
FIG. 6 illustrates the functioning of the collimating elements for the first light function of the device.

In an embodiment of FIGS. 1*a*, 2*a*, 3 the light guiding elements 3 and the collimating elements 4 are formed in a common one-piece light guiding body A, whereby the output of the light beams from the light guiding elements 3 is situated in the direction of the light propagation behind (i.e., beyond) the level 6 of the exit ends of the collimating elements 4, or, in other words, behind (i.e., beyond) the level of the mutual intersection of reflective surfaces 40 of the collimating elements 4 and the circumferential walls of the light guiding elements 3, as shown in FIG. 5 and from where it is scattered into the output surface of the lighting device according to the invention. In this exemplary embodiment, the light guiding body A has a continuous output surface A0 of light.

Figure 1B:
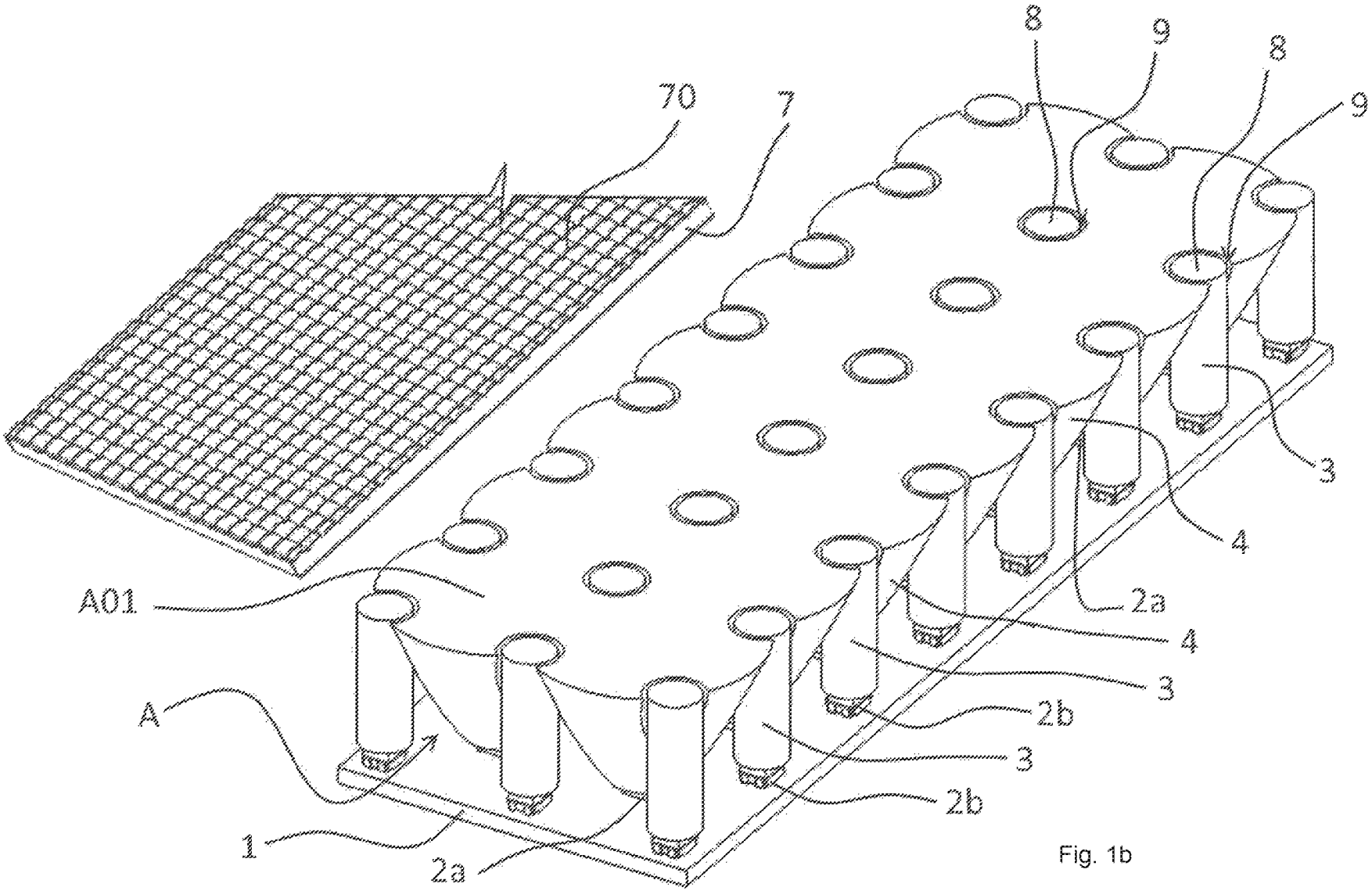
FIG. 1*b* shows an arrangement of a lighting device according to the second embodiment.
Figure 2B:
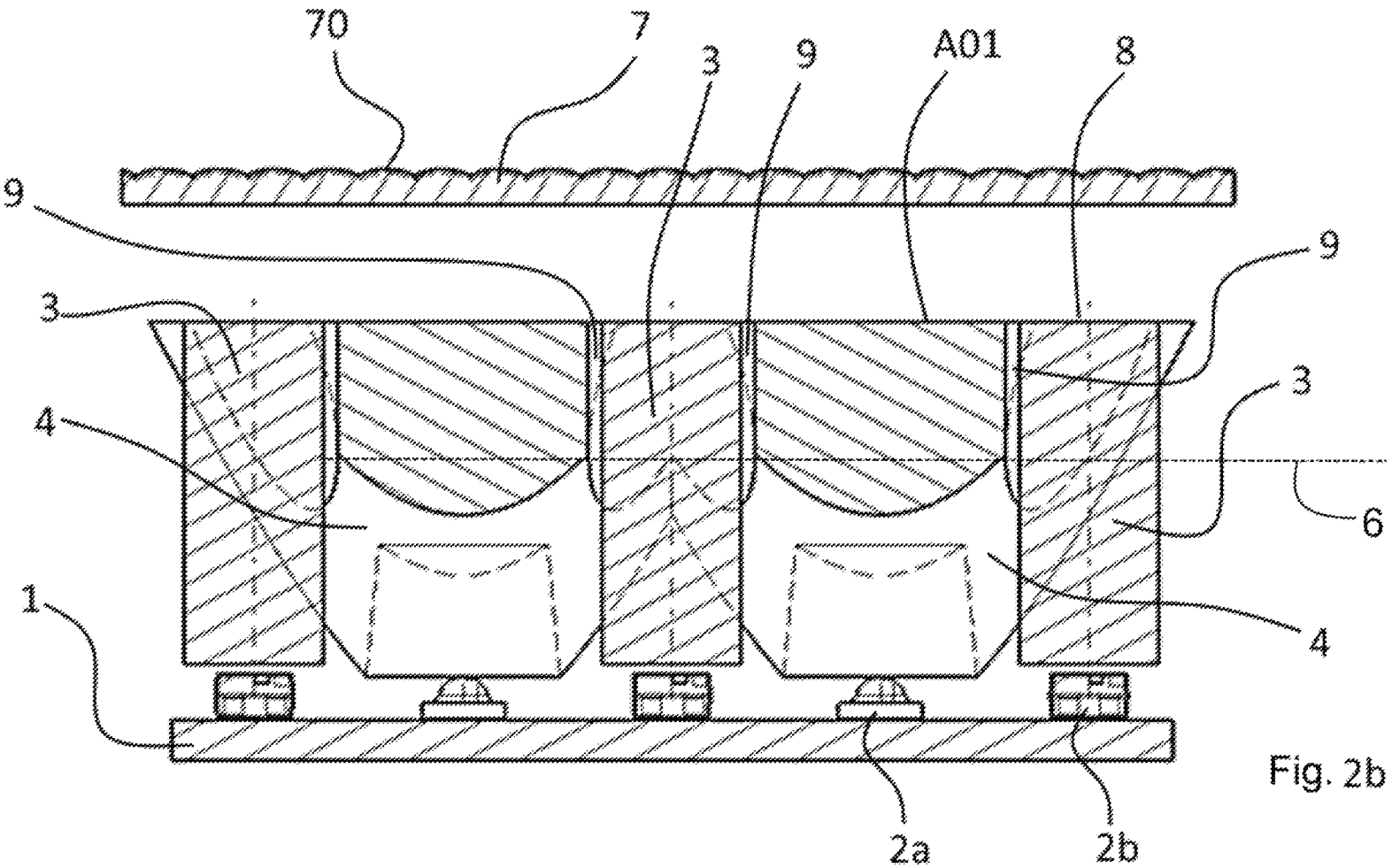
FIG. 2*b* is a cross-sectional view of a row of collimators in the embodiment of the invention according to FIG. 1*b;*

In an embodiment in FIG. 1*b*, 2*b*, the light guiding elements 3 are formed by separate optical components, which are inserted into technological apertures 9 in the light guiding body A, in which are provided collimating elements 4 and with which it thus constitutes one unit. In this exemplary embodiment, the output surface of the light guiding elements 3 is formed by a circular end surface 8 of the separate optical components, which is at the same time the output of light beams from the light guiding elements 3 situated behind (i.e., beyond) the level 6 of the exit ends of the collimating elements 4 from where the light is scattered into the output surface of the lighting device according to the invention. In this exemplary embodiment, the light guiding body A has an output surface A0 of light formed by the output surface A01 and the circular end surfaces 8 of the separate optical components constituting the light guiding elements 3.

By the cylindrical or slightly conical design of the light guiding elements 3 it is achieved that the output characteristic of the light beams which come out from the light guiding elements 3 above the level 6 of the output ends of the collimating elements 4 is substantially identical to the output characteristic of the light beams coming out directly from the secondary light sources 2*b*, i.e., as if the secondary light sources 2*b* were located immediately above the level 6 of the output ends of the collimating elements 4.

In the exemplary embodiments shown, the primary and the secondary light sources 2*a* and 2*b* are arranged in a common plane, which allows, with advantage, their installation on a common PCB 1, constituting their carrier, whereby the collimating elements 4 and the light guiding elements 3 have a mutually corresponding or identical length. In an unillustrated embodiment, the collimating elements 4 and the light guiding elements 3 have mutually different lengths and, consequently, the primary and secondary light sources 2*a* and 2*b* are arranged in mutually different height positions corresponding to the different lengths of the collimating elements 4 and of the light guiding elements 3. Apparently, the length variability of the system of the collimating elements 4 and light guiding elements 3 and the relative height position of the primary and secondary light sources 2*a* and 2*b* is possible and allows spatial arrangement of the entire system within the required volume and area according to the current requirements.

Figure 7:
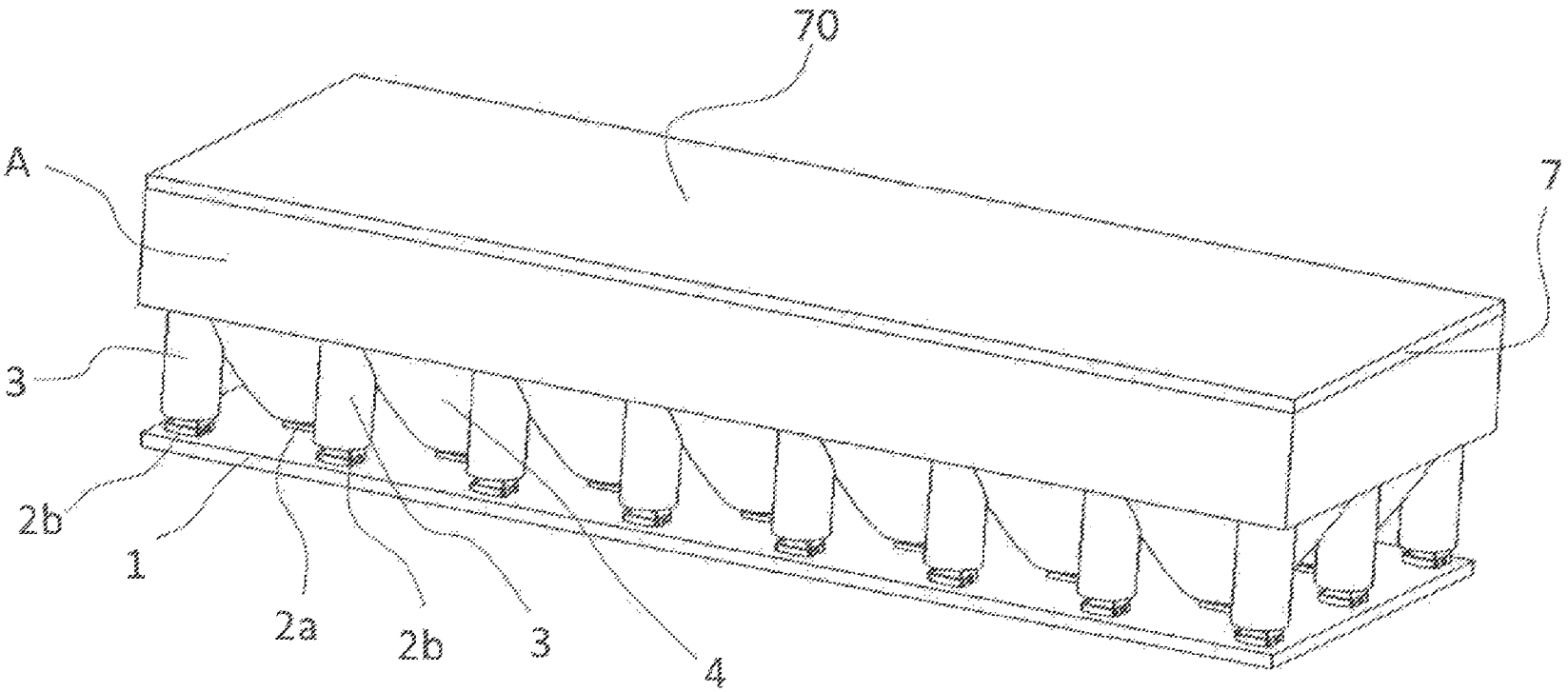
FIG. 7 shows a preferred embodiment of the lighting device according to FIGS. 1*a* and 1*b*.

To achieve the desired homogeneity of the output light beam, a light scattering filter 7 for improving the lateral scattering of the light beams from the light sources 2*a* and the secondary light sources 2*b* is located beyond the light guiding body A in the direction of the light beam path from light guiding body A, or from the collimating elements 4 and the light guiding elements 3. For improved lateral scattering of these light beams, the common output surface A of the light guiding body A or the upper surface A01 and/or the circular upper surface 8 of the light guiding elements 3 in the form of separate optical elements is suitably shaped, e.g., by a convex rounding, etc. The light scattering filter 7 is either clear, or has a milky white color, or, optionally, it is provided on its output side with optical elements 70 or with the so-called graining, or by leading-out optics, etc. In the embodiment in FIGS. 1*a* to 3 the light scattering filter 7 is formed by a separate body. In the embodiment of FIG. 7 the light scattering filter 7 is part of the light guiding body A.

Figure 4:
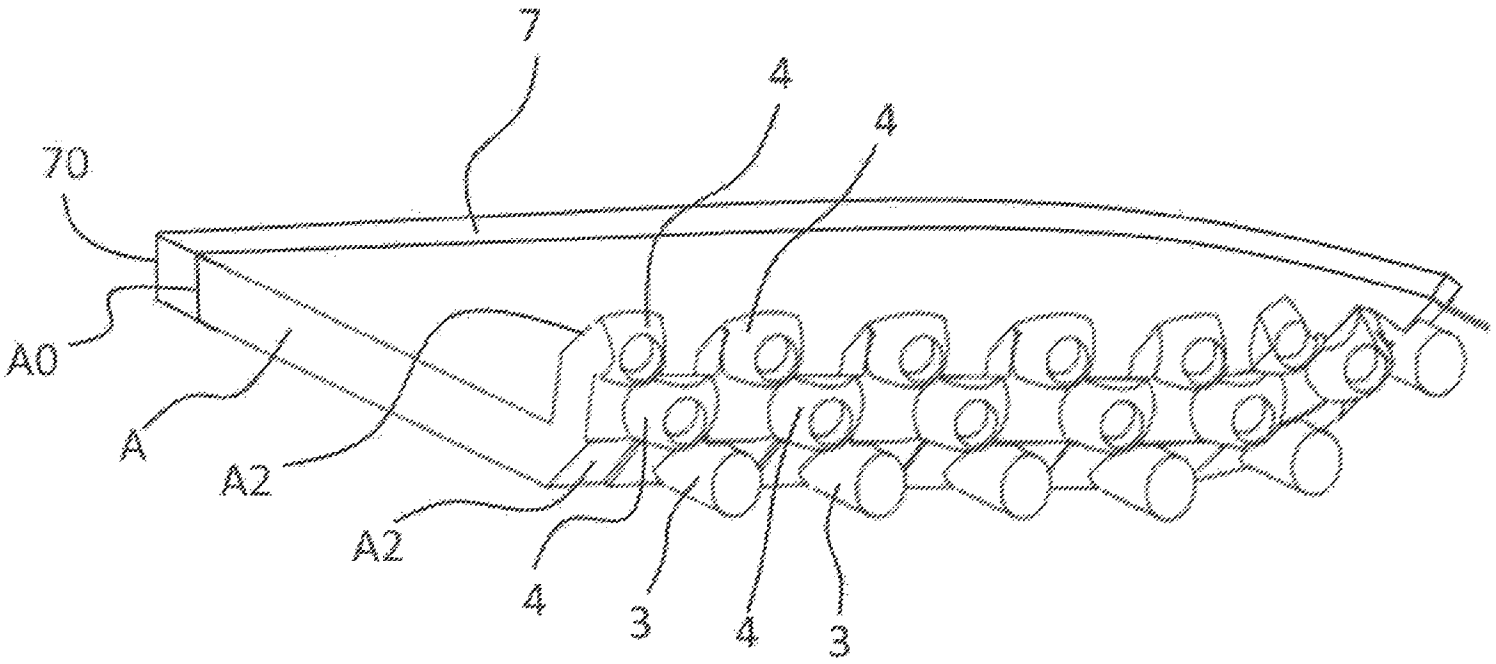
FIG. 4 shows the third embodiment of the invention in a 3D view.

In an embodiment in FIG. 4, a specific arrangement of the invention is shown, wherein the light guiding body A is formed by a flat light guide, on whose rear portion is arranged an assembly of light guiding elements 3 and an assembly of collimating elements 4, which has in this embodiment two rows of the collimating elements 4 arranged above the row of light guiding elements 3. Each of the collimating elements 4 is associated with a primary light source 2*a* (not shown) to perform the first light function and each of the light guiding elements 3 is associated with a secondary light source 2*b* to perform the second light function. Preferably, the primary light source 2*a* and the secondary light source 2*b* are in this embodiment located on a common carrier 1 (not shown). The light guiding elements 3 are with their longitudinal axes directed in a plane of the flat light guide, whereby the collimating elements 4 are with their longitudinal axes directed against the reflective surfaces A2 to reflect the light collimated by the collimating elements 4 to the plane of the flat light guide, or, in other words, to the direction close to the direction of the plane of the flat light guide. Optionally, the light scattering filter 7 is arranged on the front output surface of the flat light guide. This embodiment makes it possible to achieve the functionality of the present invention even with very spatially limited structures.

Figure 8:
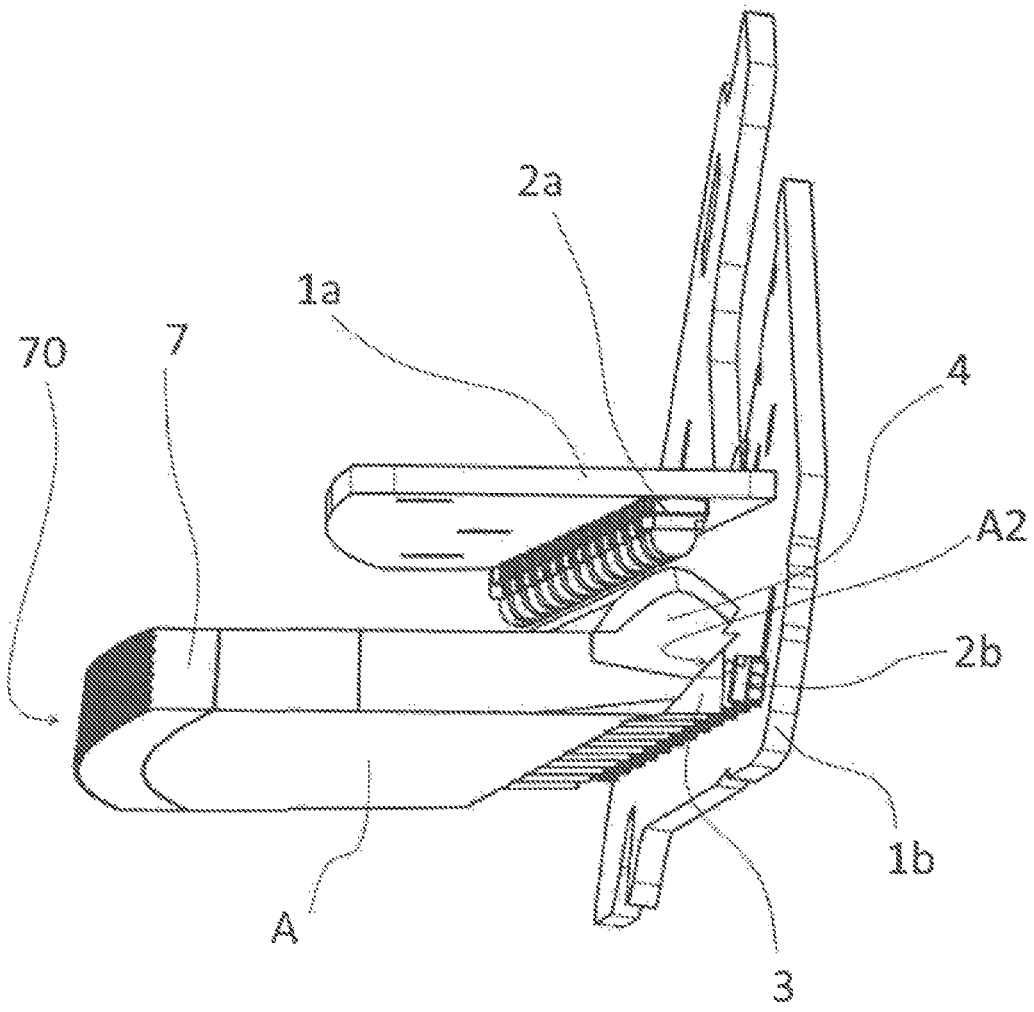
FIG. 8 shows a preferred embodiment of the lighting device according to FIG. 4.

In an embodiment of FIG. 8, which shows a modified embodiment of FIG. 4, the light guiding body A is formed by a flat light guide, on whose rear portion a set of light guiding elements 3 is arranged next to each other in a row and spaced apart, whereby the light guiding elements 3 are directed with their longitudinal axes in the plane of the flat light guide. An assembly of collimating elements 4 is also arranged in a rear portion of the light guiding body A perpendicularly to the row of the light guiding elements 3, whereby opposite each collimating element 4 at the rear end of the light guiding body A, an oblique reflective surface A2 is arranged to reflect the light collimated by the collimating elements 4 into the plane of the flat light guide, or, more specifically, into the direction close to the direction of the flat light guide plane. Each of the collimating elements 4 is associated with a primary light source 2*a* to perform the first light function and each of the light guiding elements 3 is associated with a secondary light source 2*b* to perform the second light function. The primary light source 2*a* is arranged on a first carrier 1*a* and the secondary light source 2*b* is arranged on a second carrier 1*b*. A light scattering filter 7 is arranged on the front output surface of the flat light guide, whereby the light scattering filter 7 is either clear, or has a milky white color, or, optionally, it is provided on its output side with optical elements 70 or with the so-called graining, or by leading-out optics, etc. This embodiment enables to achieve functionality of the invention even in spatially structured designs.

The invention claimed is:

1. A lighting device with a multiple light function comprising:

a plurality of primary light sources for emitting light beams;

a plurality of secondary light source for emitting light beams;

optical elements adapted to receive and guide the light beams from the primary light sources and the secondary light sources, the optical elements including collimating elements associated with the primary light sources and light guiding elements associated with the secondary light sources, the collimating elements and the light guiding elements being arranged in a light guiding body, an output of the light beams from the light guiding elements being situated in a direction of light propagation beyond a level of exit ends of the collimating elements; and a light scattering filter located to receive and scatter the light beams received from the optical elements.

2. The lighting device with a multiple light function according to claim 1, wherein the light guiding body is a one-piece light guiding body including the collimating elements and the light guiding elements.

3. The lighting device with a multiple light function according to claim 1, wherein the collimating elements are formed unitarily in the light guiding body, the light guiding body defining apertures between the collimating elements, the light guiding elements including separate elements located in the apertures, the light guiding elements each having an output surface configured as a circular end surface.

4. The lighting device with a multiple light function according to claim 1, wherein the light guiding body is configured as a flat light guide having a rear portion on which the light guiding elements and the collimating elements are arranged, each of the collimating elements being associated with a respective one of the primary light sources and each of the light guiding elements being associated with a respective one of the secondary light sources, the light guiding elements being arranged on the rear portion so that longitudinal axes of the light guiding elements align with a plane of the flat light guide, the collimating elements being arranged on the rear portion so that longitudinal axes of the collimating elements align with reflective surfaces of the light guiding body for reflecting the light beams from the collimating elements into the plane of the flat light guide.

5. The lighting device with a multiple light function according to claim 1, wherein the primary light sources and the secondary light sources are mounted on a common carrier.

6. The lighting device with a multiple light function according to claim 1, wherein the primary light sources and the secondary light sources are mounted on a common carrier in a common plane.

7. The lighting device with a multiple light function according to claim 1, wherein the primary light sources and the secondary light sources are mounted on separate carriers.

8. The lighting device with a multiple light function according to claim 1, wherein the light guiding elements are each configured with a cylindrical shape.

9. The lighting device with a multiple light function according to claim 1, wherein the light guiding elements are each configured with a frustoconical shape.

10. The lighting device with a multiple light function according to claim 1, wherein the collimating elements are each configured with a rotational collimating reflective surface having a center with an input surface for receiving the light beams from a respective one of the primary light sources, the input surfaces each being configured as a hollow, slightly conical surface with a concave face.

11. The lighting device with a multiple light function according to claim 1, wherein the primary light sources and the secondary light sources each include respective LED arrays arranged in a matrix.

* * * * *